US008757773B2

(12) United States Patent
Shinoda

(10) Patent No.: US 8,757,773 B2
(45) Date of Patent: Jun. 24, 2014

(54) RECORDING APPARATUS AND POSITION ADJUSTING METHOD OF RECORDING HEAD

(75) Inventor: Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 150 days.

(21) Appl. No.: 12/892,811

(22) Filed: Sep. 28, 2010

(65) Prior Publication Data

US 2011/0074877 A1 Mar. 31, 2011

(30) Foreign Application Priority Data

Sep. 29, 2009 (JP) ..... 2009-224391

(51) Int. Cl.
*B41J 2/155* (2006.01)

(52) U.S. Cl.
USPC ..... 347/42

(58) Field of Classification Search
USPC ..... 347/42
See application file for complete search history.

(56) References Cited

U.S. PATENT DOCUMENTS

| | | | | |
|---|---|---|---|---|
| 5,486,849 | A | 1/1996 | Miura et al. | |
| 7,270,387 | B2 | 9/2007 | Ueda et al. | |
| 2002/0024554 | A1 * | 2/2002 | Tominaga | 347/37 |
| 2006/0170732 | A1 | 8/2006 | Yamada | |
| 2009/0058921 | A1 | 3/2009 | Habashi | |
| 2009/0147048 | A1 | 6/2009 | Zhao et al. | |

FOREIGN PATENT DOCUMENTS

| | | | |
|---|---|---|---|
| CN | 101456302 | A | 6/2009 |
| JP | S63-057244 | A | 3/1988 |
| JP | H03-290252 | A | 12/1991 |
| JP | H10-006518 | A | 1/1998 |
| JP | 2003-341087 | A | 12/2003 |
| JP | 2006-035431 | A | 2/2006 |
| JP | 2006-205689 | A | 8/2006 |
| JP | 2007-090695 | A | 4/2007 |
| JP | 2007-223196 | A | 9/2007 |
| JP | 2007-276426 | A | 10/2007 |
| JP | 2008-062583 | A | 3/2008 |
| JP | 2008-132795 | A | 6/2008 |
| JP | 2009-078539 | A | 4/2009 |

OTHER PUBLICATIONS

Machine translation of JP 2007-276426 A.*
Japan Patent Office, Notice of Reasons for Rejection for Japanese Patent Application No. 2009-224391 (counterpart Japanese patent application), mailed Mar. 12, 2013.

(Continued)

*Primary Examiner* — Justin Seo
(74) *Attorney, Agent, or Firm* — Baker Botts L.L.P.

(57) ABSTRACT

A recording apparatus may include a recording head including a discharge surface in which liquid discharge openings are arranged in a particular direction. The recording apparatus may include a supplying member which is positioned at a first end portion in the particular direction, and supplies the liquid to the recording head. The recording apparatus may include a liquid supplying device which is connected to the supplying member, and supplies the liquid to the recording head. The recording apparatus may include a position adjusting device including a contact member which contacts the recording head, and adjusts a position of the recording head by moving the contact member. The position adjusting device may be positioned at a second end portion opposite to the first end portion in the particular direction.

15 Claims, 6 Drawing Sheets

(56) References Cited

OTHER PUBLICATIONS

The State Intellectual Property Office of the People'S Republic of China, Notification of First Office Action for Chinese Patent Application No. 201010299464.9 (counterpart Chinese patent application), issued Dec. 5, 2012.

State Intellectual Property Office of the People'S Republic of China, Notification of the Second Office Action for Chinese Patent Application No. 201010299464.9 (counterpart to above-captioned patent application), mailed Aug. 1, 2013.

* cited by examiner

RECORDING APPARATUS AND POSITION ADJUSTING METHOD OF RECORDING HEAD

CROSS REFERENCE TO RELATED APPLICATION

This application claims priority to Japanese Patent Application No. 2009-224391, filed Sep. 29, 2009, the entire subject matter and disclosure of which is incorporated herein by reference.

BACKGROUND OF THE DISCLOSURE

1. Field of the Disclosure

The features herein relate to a recording apparatus including a recording head which discharges liquid so as to record an image onto a recording medium.

2. Description of the Related Art

A known recording apparatus includes an adjusting device which is configured to adjust the position of a recording head which discharges liquid. The recording apparatus further includes a liquid supplying device which is positioned near the recording head to supply liquid to the recording head. Depending upon the positional relationship between the adjusting devices and the liquid supplying device, it may be difficult to adjust the position of the recording head.

SUMMARY OF THE DISCLOSURE

In an embodiment of the invention, a recording apparatus may comprise a recording head comprising a discharge surface in which a plurality of liquid discharge openings are arranged in a particular direction. The recording apparatus may comprise a supplying member which is positioned at a first end portion in the particular direction, and is configured to supply the liquid to the recording head. The recording apparatus may comprise a liquid supplying device which is connected to the supplying member, and is configured to supply the liquid to the recording head. The recording apparatus may comprise a position adjusting device comprising a contact member which contacts the recording head, and is configured to adjust a position of the recording head by moving the contact member. The position adjusting device may be positioned at a second end portion opposite to the first end portion in the particular direction.

Another embodiment of the invention describes a position adjusting method of a recording head, the recording head comprising a discharge surface having a plurality of discharge openings arranged in a particular direction. The method may comprise the step of operating a position adjusting device to move a contact member. The method may comprise the step of contacting the recording head with the contact member, the recording head having a first end and a second end opposite the first end in the particular direction. The method may comprise the step of moving the second end of the recording head. The method may comprise the step of holding stationary the first end of the recording head, to supply liquid to the recording head from a supplying member disposed at the first end. The moving step and the holding step may occur simultaneously.

Other objects, features, and advantages of embodiments of the present invention will be apparent to persons of ordinary skill in the art from the following description of embodiments with reference to the accompanying drawings.

BRIEF DESCRIPTION OF THE DRAWINGS

Embodiments of a recording apparatus are described with reference to the accompanying drawings, which are given by way of example only, and are not intended to limit the present patent.

DETAILED DESCRIPTION OF EMBODIMENTS

Various embodiments, and their features and advantages, may be understood by referring to FIGS. 1-6, like numerals being used for corresponding parts in the various drawings.

Figure 1:
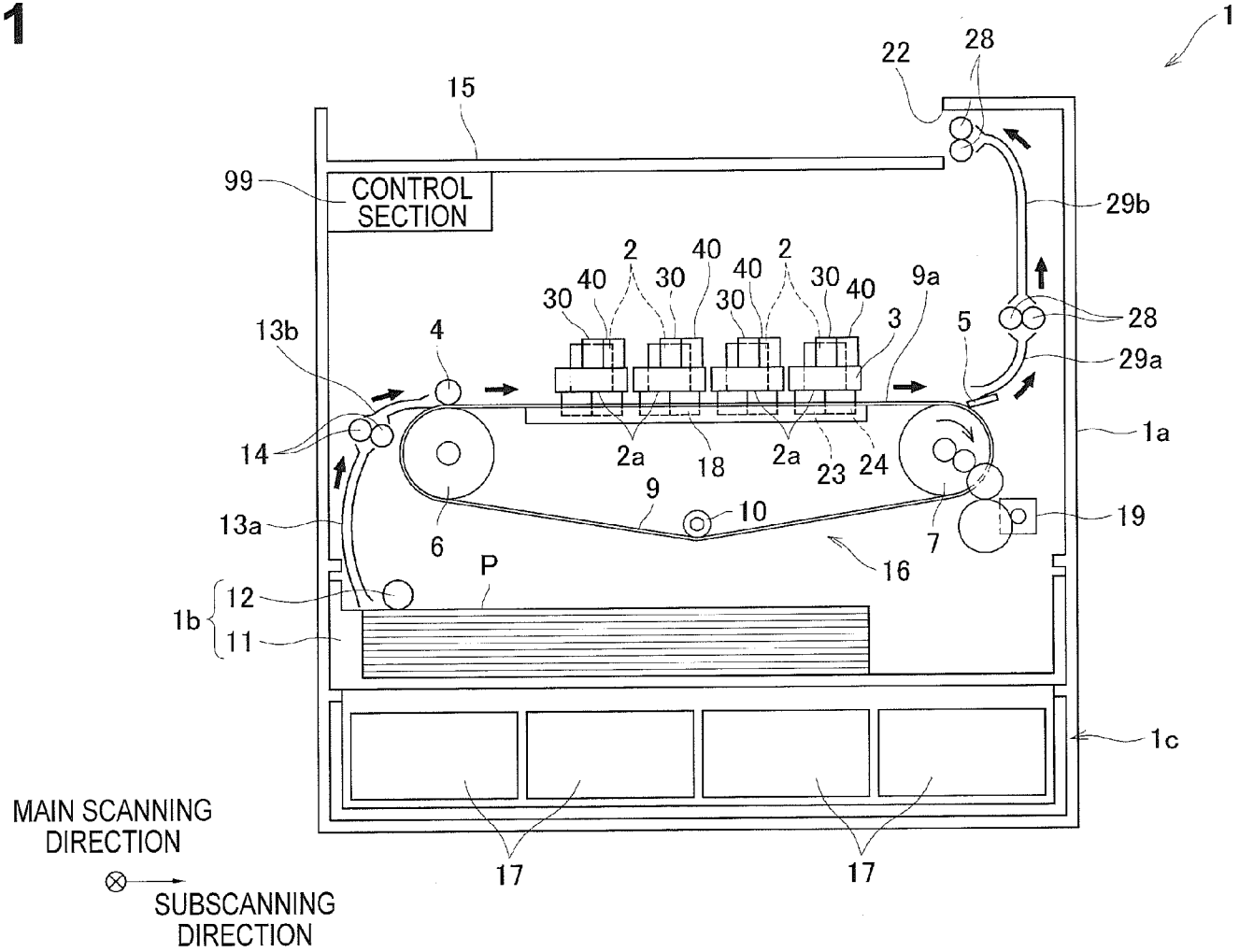
FIG. 1 is a schematic view of an internal structure of an inkjet printer according to an embodiment.

Referring to FIG. 1, an inkjet printer 1 may include a rectangular parallelepiped housing 1*a*. A plurality of, e.g., four, inkjet heads 2 (hereafter referred to as "heads" 2) and a conveying mechanism 16 may be disposed in the housing 1*a*. The plurality of, e.g., four, heads 2 may discharge a plurality of, e.g., four colors, respectively.

A control section 99 which is configured to control operations of, for example, the heads 2 and the conveying mechanism 16 may be mounted to an inner surface of a top plate of the housing 1*a*. A discharge section 15 may be disposed at an upper surface of the top plate. Sheets P, on which images are formed by ink discharged from the heads 2, may be discharged onto the discharge section 15. A sheet-feed unit 1*b* including a sheet-feed tray 11, which may be removably mounted to the housing 1*a*, may be disposed below the conveying mechanism 16. An ink tank unit 1*c*, which also may be removably mounted to the housing 1*a*, may be disposed below the sheet-feed unit 1*b*.

A sheet conveying path may be formed in the interior of the inkjet printer 1, along thick arrows shown in FIG. 1. The sheets P may be conveyed from the sheet-feed unit 1*b* to the discharge section 15. The sheet-feed unit 1*b* may include the sheet-feed tray 11 and a sheet-feed roller 12. The sheet-feed tray 11 may have a box-shape having an open top, and may hold the sheets P in a stacked state. The sheet-feed roller 12 may send out the topmost sheet P in the sheet-feed tray 11. The sent out sheet P may be conveyed to the conveying mechanism 16 by guides 13*a* and 13*b*, which guide the sent out sheet P, and by a feed roller pair 14, which nip the sent out sheet P.

The conveying mechanism 16 may include a plurality of, e.g., two, belt rollers 6 and 7, a conveying belt 9, a tension roller 10, and a platen 18. The conveying belt 9 may be an endless belt which is wound around between the rollers 6 and 7. At a lower loop of the conveying belt 9, the tension roller 10 may be urged downward while contacting the inner peripheral surface of the conveying belt 9, such that a tension is applied to the conveying belt 9.

The platen 18 may be disposed at an inner area of the conveying belt 9. At a position opposing each head 2, the platen 18 may support the conveying belt 9 such that the conveying belt 9 is not flexed downward. The belt roller 7 may be a driving roller. By applying a driving force to an axis of the belt roller 7 from a conveying motor through, for example, a gear, the belt roller 7 may rotate clockwise when positioned as shown in FIG. 1. The belt roller 6 may be a driven roller. The belt roller 6 may rotate clockwise when positioned as shown in FIG. 1 by movement of the conveying belt 9 caused by rotation of the belt roller 7.

An outer peripheral surface 9*a* of the conveying belt 9 may have adhesive characteristics, which may be made by siliconizing. A nip roller 4 may be disposed so as to oppose the belt roller 6. The nip roller 4 may cause a sheet P sent out from the sheet-feed unit 1*b* to be pressed against the outer peripheral surface 9*a* of the conveying belt 9. The sheet P may be conveyed in a sheet conveying direction, i.e., a sub scanning direction, i.e., rightward when positioned as shown in FIG. 1, while being held on the outer peripheral surface 9*a* by an adhesive force of the outer peripheral surface 9*a*.

A separation plate 5 may be disposed so as to oppose the belt roller 7. The separation plate 5 may separate the sheet P from the outer peripheral surface 9*a*. The separated sheet P may be conveyed by being guided by guides 29*a* and 29*b* and being nipped by a plurality of, e.g., two, feed roller pairs 28. Then, the sheet P may be discharged from a discharge opening 22, which may be formed in the upper portion of the housing 1*a*, to the discharge section 15, which may be positioned at the upper surface of the top plate of the housing 1*a*.

Figure 3A:
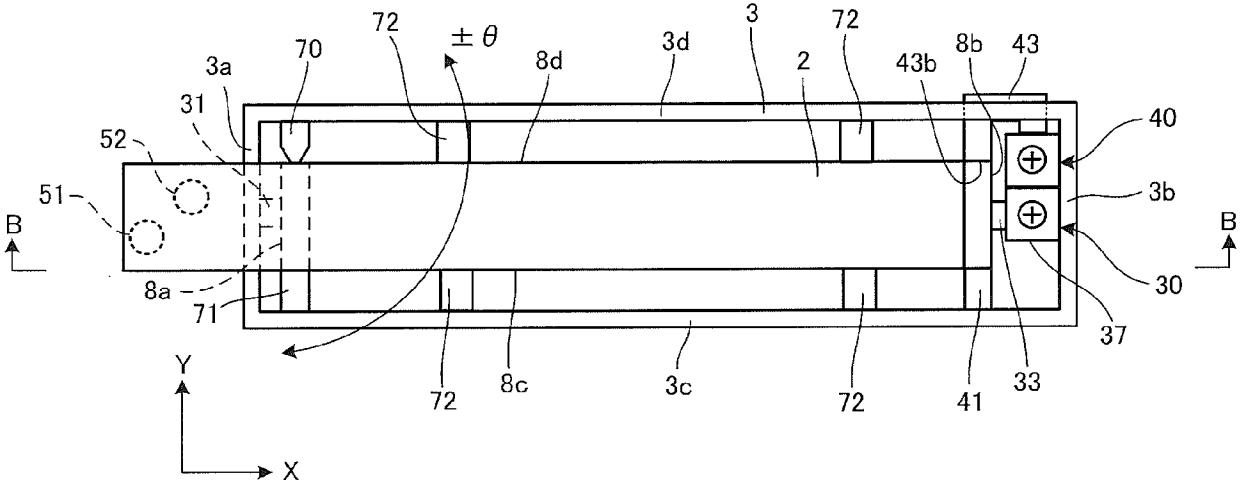
FIG. 3A is a plan view of the vicinity of the inkjet head.
Figure 3B:
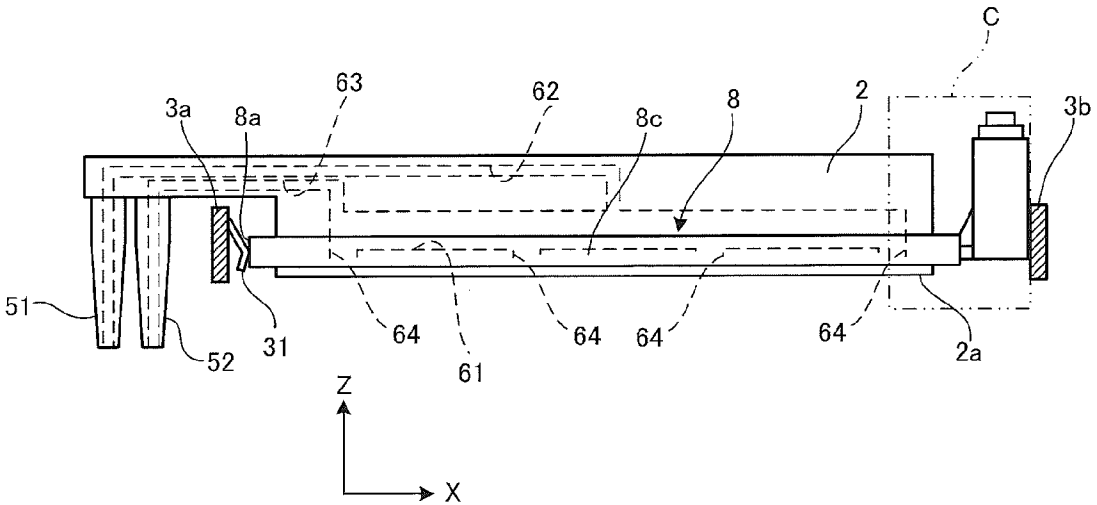
FIG. 3B is a sectional view taken along line B-B in FIG. 3A, according to an embodiment of the invention.
Figure 5:
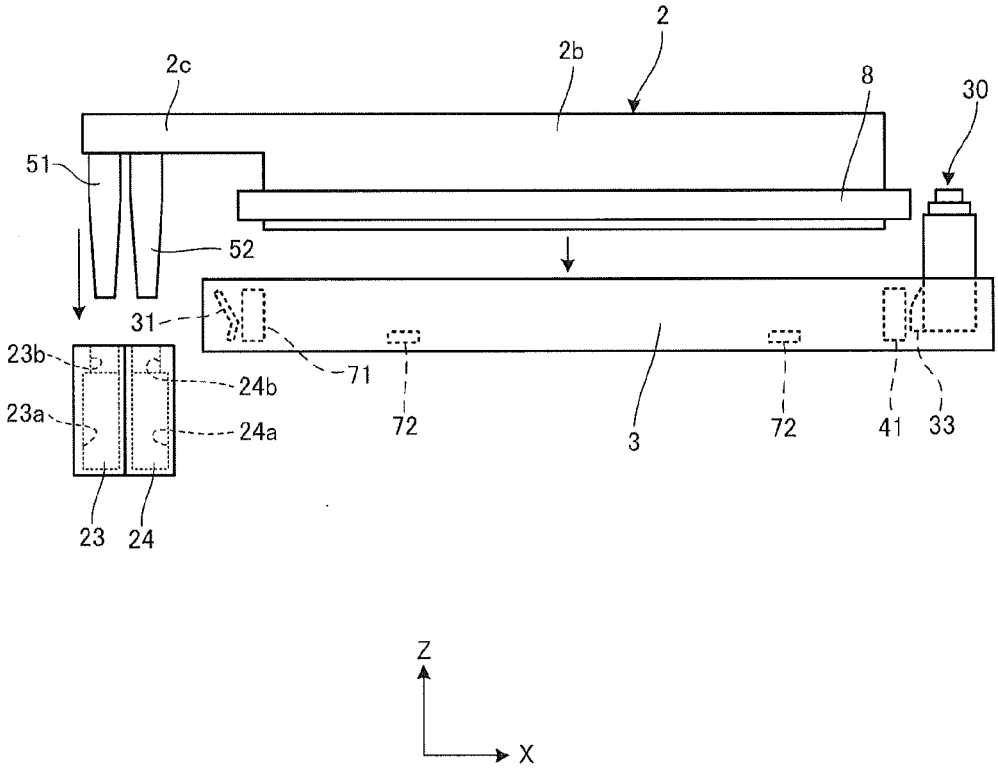
FIG. 5 is a front view of a state of the inkjet printer in which the inkjet head is removed, according to an embodiment of the invention.
Figure 6:
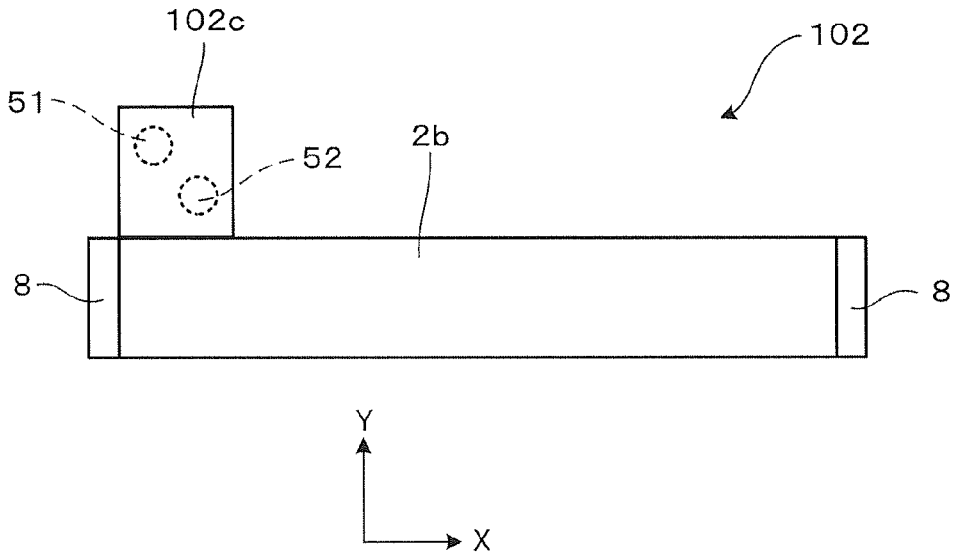
FIG. 6 is a plan view of an inkjet head according to another embodiment of the invention.

The plurality of, e.g., four, heads 2 each may have a substantially parallelepiped shape which is elongated in a main scanning direction, e.g., as shown in FIGS. 3A and 3B. The heads 2 may be arranged side by side in the conveying direction of sheet P and may be secured to the housing 1*a*. The printer 1 may be a line printer, with the conveying direction and the main scanning direction being orthogonal to each other. The heads 2 may be supported by a head supporting frame 3 which is secured to the housing 1*a*. The heads 2 may be removably mounted to the head supporting frame 3, e.g., as shown in FIGS. 1 and 5.

The lower surface of each head 2 may include a plurality of discharge openings for discharging ink, and may be configured as a discharge surface 2*a*. The discharge openings may be arranged along the main scanning direction in each discharge surface 2*a*. The plurality of, e.g., four, ink tanks 17 may store inks having colors that differ from each other. Magenta, cyan, yellow, and black inks may be supplied to the heads 2 from the ink tanks 17. When the sheet P conveyed by the conveying mechanism passes directly below the plurality of, e.g., four, heads 2, the inks having the respective colors may be sequentially discharged towards the upper surface of the sheet P from each discharge surface 2*a*. Accordingly, a predetermined color image may be formed on the upper surface, that is, the print surface of the sheet P. Each discharge surface 2*a* may be a planar surface which is elongated in the main scanning direction. The discharge openings may be arranged in the main scanning direction of the discharge surfaces 2*a* in a range which is greater than or equal to the length of the sheet P in the main scanning direction.

Figure 2:
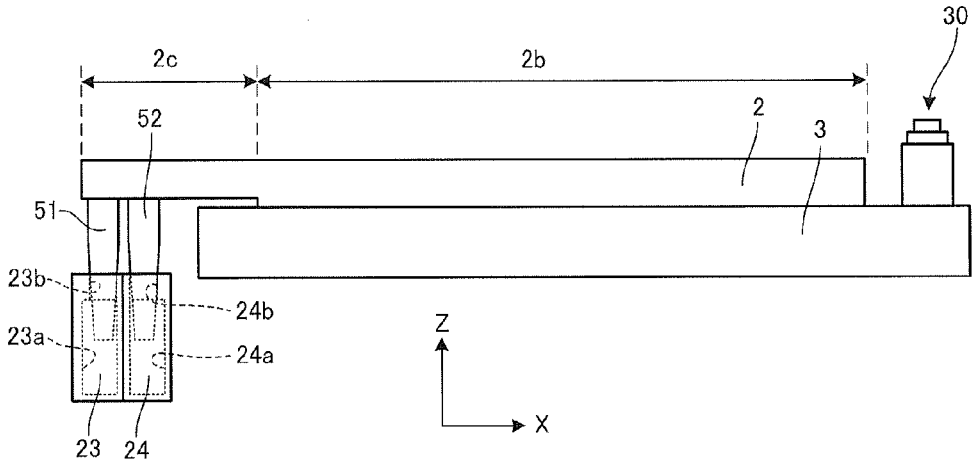
FIG. 2 is a front view of the vicinity of an inkjet head, according to an embodiment of the invention.

Referring to FIG. 2, the head 2 may include a roughly rectangular parallelepiped body portion 2*b* and a projection portion 2*c* projecting from an upper end of the body portion 2*b*. In the description below, with reference to the enclosed figures, a direction which is parallel and opposite to the main scanning direction is a +X direction, the sub scanning direction is a +Y direction, and an upward vertical direction is a +Z direction. The projection portion 2*c* may project towards a −X direction, e.g., leftwards in FIG. 2, from one end portion, e.g., left end in FIG. 2, as viewed in the X direction of the body portion 2*b*.

The body portion 2*b* may be a layered body portion configured by vertically stacking a plurality of members. Referring to FIGS. 3A and 3B, a flat member 8, which is one of the members, may be formed so as to be longer in the X direction than the other members which are stacked upon each other. In FIGS. 3A and 3B, only the flat member 8 is shown as being distinguished from the other members that are stacked upon each other, and the other members are omitted. The flat member 8 may include a plurality of, e.g., four, side surfaces 8*a* to 8*d*. Of the side surfaces 8*a* to 8*d*, the two side surfaces extending along the Y direction may be the side surfaces 8*a* and 8*b*, and the two side surfaces extending along the X direction, e.g., perpendicular to the directions of side surfaces 8*a* and 8*b*, may be the side surfaces 8*c* and 8*d*.

The head supporting frame 3 may be disposed along the periphery of the body portion 2*b* when viewed in plan view. The head supporting frame 3 may horizontally surround the body portion 2*b* from all sides. The head supporting frame 3 may have a plurality of, e.g., four, side walls 3*a* to 3*d* opposing the plurality of, e.g., four, side surfaces 8*a* to 8*d* of the flat member 8, respectively. The body portion 2*b* may be vertically supported by the head supporting frame 3 by supporting members 72. The supporting members 72 may support the body portion 2*b* in such a manner as to allow the body portion 2*b* to move slightly in the X direction and the Y direction. The body portion 2*b* may be horizontally supported by the head supporting frame 3 through, for example, head position adjusting devices 30 and 40.

Referring to FIG. 3B, an ink reservoir 61 may be formed in the body portion 2*b*. A plurality of downwardly extending ink paths 64 may be in fluid communication with the ink reservoir 61 at one end. The other end of each ink path 64 may be in fluid communication with each discharge opening in the discharge surface 2*a*. Vertically downwardly extending ink path pipes 51 and 52 may be disposed in the lower surface of the projection portion 2*c*. Ink paths 62 and 63 may be formed in the interiors of the ink path pipes 51 and 52. The ink path 62 may open at the lower end of the ink path pipe 51. From the opening, the ink path 62 may extend vertically upwards towards the projection portion 2*c* through the interior of the ink path pipe 51. In addition, the ink path 62 may extend through the interior of the projection portion 2*c* and towards the body portion 2*b*, and may communicate with the ink reservoir 61. The ink path 63 may open at the lower end of the ink path pipe 52. From the opening, the ink path 63 may extend vertically upwards towards the projection portion 2*c* through the interior of the ink path pipe 52. In addition, the ink path 63 may extend through the interior of the projection portion 2*c* and towards the body portion 2*b*, and may be in fluid communication with the ink reservoir 61 at a location differing from that of the ink path 62.

The ink path pipes 51 and 52 may be connected to a sub tank unit 23 and a sub tank unit 24, which may be secured to predetermined positions in the housing 1*a*. The sub tank units 23 and 24 may be positioned with respect to the head supporting frame 3 and may be secured such that the sub tank units 23 and 24 are connected to the ink path pipes 51 and 52, respectively. Ink reservoirs 23*a* and 24*a* which store ink may be formed in the sub tank units 23 and 24, respectively. Ink from the corresponding ink tank 17 may be supplied to the ink reservoir 23*a*, and ink discharged from the head 2 may be stored in the ink reservoir 24*a*.

Insertion portions 23*b* and 24*b* in which ends of the ink path pipes 51 and 52 are inserted, respectively, may be disposed above the ink reservoirs 23*a* and 24*a*. The insertion portions 23*b* and 24*b* may be in fluid communication with the ink reservoirs 23*a* and 24*a*, respectively. The ink path pipes 51 and 52 may be configured such that, through the openings at the lower ends thereof, the ink paths 62 and 63 in the ink flow path pipes 51 and 52 are in fluid communication with the ink reservoirs 23*a* and 24*a*, respectively. When the ink path pipe 51 is inserted in the insertion portion 23*b*, the outer surface of the ink path pipe 51 may contact an inner surface of the insertion portion 23*b*, and may block the insertion portion 23*b*. Similarly, when the ink path pipe 52 is inserted in the insertion portion 24*b*, the outer surface of the ink path pipe 52 may contact an inner surface of the insertion portion 24*b*, and may block the insertion portion 24*b*. Accordingly, the insertion portions 23*b* and 24*b* may be blocked such that the ink reservoirs 23*a* and 24*a* do not contact air from outside the ink reservoirs 23*a* and 24*a*.

An ink supplying path extending from each ink tank 17 to each head 2 through each sub tank unit 23 and each ink path pipe 51 may be formed between each head 2 and each sub tank unit 23. In addition, an ink discharging path extending from each head 2 to each sub tank unit 24 through each ink path pipe 52 may be formed between each head 2 and each sub tank unit 24. An ink supplying pump may be included in each sub tank unit 23. Ink may be supplied to each head 2 from each ink tank 17 through the ink supplying path by each respective ink supplying pump. A pump which draws ink from the interior of each head 2 through each ink path pipe 52 and forcefully discharges ink to each sub tank unit 24 may be connected to the ink discharging path. This causes foreign matter, such as air bubbles which have entered each head 2, to be reliably discharged to each sub tank unit 24. In addition, an ink path which returns the ink discharged from each head 2 to each sub tank unit 24 to each sub tank unit 23 may be formed.

The sub tank units 23 and 24, the ink path pipes 51 and 52, and the heads 2 may be configured of materials which have high gas barrier characteristics, e.g., low gas permeability and are hard overall. A whole structure including the sub tank units 23 and 24 and heads 2 connected to each other is configured to have low flexibility. Accordingly, the gas barrier characteristics and the stability of ink supply of this structure may be higher than those of a structure using a flexible member, e.g., an ink tube, at the portion where the sub tank units 23 and 24 and heads 2 are disposed. The ink path extending from each sub tank unit 23 to each head 2 and the ink path extending from each sub tank 24 to each head 2 may be connected together, such that the connection between the ink paths becomes reliable and stable.

Head position adjusting devices 30 and 40 may be disposed at an end portion of the head 2 at a side opposite to the ink path pipes 51 and 52 in the X direction. The head position adjusting devices 30 and 40 may be secured to the head supporting frame 3. The position of each head 2 can be adjusted, by manually operating the head position adjusting devices 30 and 40. The head position adjusting devices 30 and 40 may be provided for each head 2, and may be positioned on the same side of each head 2 in the main scanning direction so as to be arranged in a row in the sub scanning direction, e.g., as shown in FIG. 1. Accordingly, since manual position adjustments of all of the heads 2 are carried out from the same side in the main scanning direction, the manual position adjustments may be easily performed.

Referring to FIG. 3A, a reference contact member 70 which functions as a reference for position adjustment by the head position adjusting devices 30 and 40 may be disposed between the head supporting frame 3 and the head 2. The reference contact member 70 may be secured to the side wall 3*d*. The reference contact member 70 may contact an end portion of the side surface 8*d* of the flat member 8 which is closest to the ink path pipes 51 and 52 in the main scanning direction. A leaf spring 71 may urge the flat member 8 towards the reference contact member 70. The leaf spring 71 may be disposed at the side wall 3*c* of the head supporting frame 3. The leaf spring 71 may have an L shape. One end of the leaf spring 71 may be secured to the side wall 3*c*. A bent portion of the leaf spring 71 may contact the side surface 8*c*. The leaf spring 71 may cause the side surface 8*c* to be held such that the side surface 8*c* is urged in the +Y direction. One end, e.g., a left end as shown in FIG. 3A, of the side surface 8*d* of the flat member 8 may contact the reference contact member 70 by the leaf spring 71.

The head position adjusting device 30 may include a leaf spring 31 which urges the side surface 8*a* of the flat member 8 in the +X direction. Referring to FIG. 3B, the leaf spring 31 may have an L shape. One end of the leaf spring 31 may be secured to the side wall 3*a* of the head supporting frame 3. A bent portion of the leaf spring 31 may be in contact with the side surface 8*a*. The leaf spring 31 may cause the side surface 8*a* to be held such that the side surface 8*a* is urged in the +X direction.

Figure 4A:
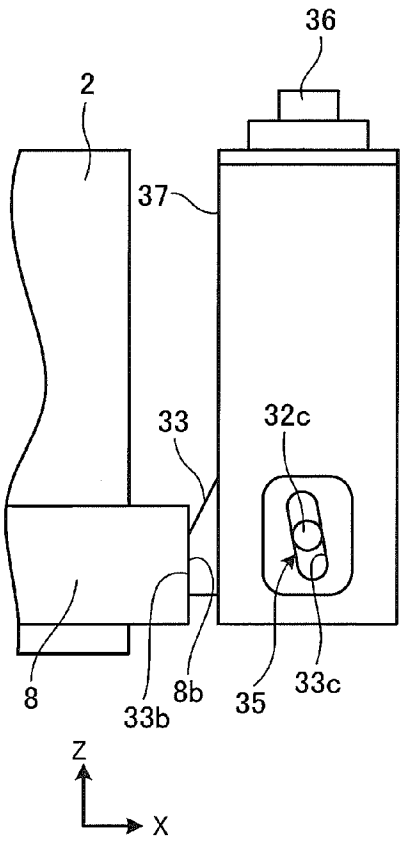
FIG. 4A is an enlarged view of a portion surrounded by an alternate long and two short dash line in FIG. 3B.
Figure 4B:
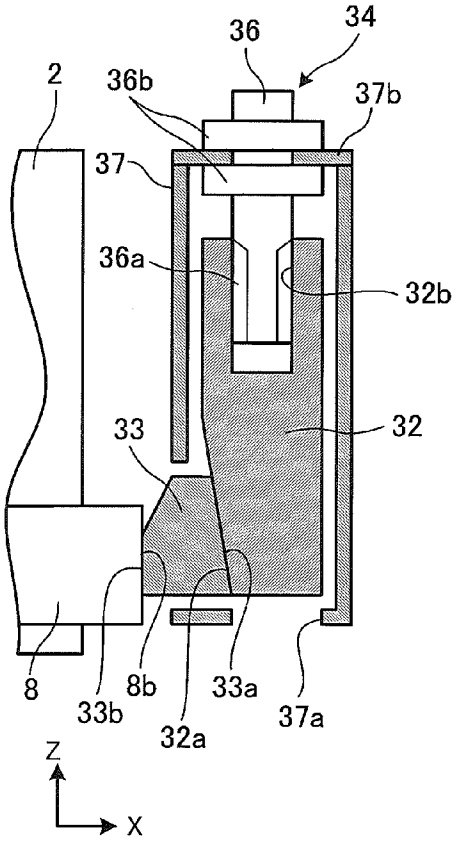
FIGS. 4B and 4C are partial sectional views of FIG. 4A.

Referring to FIG. 4B, which is a partial sectional view of FIG. 4A, the head position adjusting device 30 may include a movable member 32. The movable member 32 may have a generally prismatic shape. An inclined surface 32*a* may be disposed at a lower portion of the movable member 32. The inclined surface 32*a* may be inclined such that the thickness of the movable member 32 is reduced downward in the +X direction, when positioned as shown in FIG. 4B.

The inclination angle of the inclined surface 32*a* of the movable member 32 and a vertical width in FIG. 4 of the inclined surface 32*a* may correspond to an amount of movement of a pressing member 33 in the ±X directions. That is, if the inclination angle of the inclined surface 32*a* is small, the amount of movement of the pressing member 33 in the ±X directions may be small. If the inclination angle of the inclined surface 32*a* is large, the amount of movement of the pressing member 33 in the ±X directions may be large. If the vertical width of the inclined surface 32*a*, when positioned as shown in FIG. 4, is small, the amount of movement of the pressing member 33 in the ±X directions may be small. If the vertical width of the inclined surface 32*a*, when positioned as shown in FIG. 4, is large, the amount of movement of the pressing member 33 in the ±X directions may be large.

The head position adjusting device 30 may include the pressing member 33. The pressing member 33 may be disposed between the side surface 8*b* of the flat member 8 and the inclined surface 32*a* of the movable member 32. The pressing member 33 may include a contact surface 33*a*, which contacts the inclined surface 32*a*, and a pressing surface 33*b*, which presses the side surface 8*b*. The contact surface 33*a* may be disposed parallel to the inclined surface 32*a*, and may contact the inclined surface 32*a*. The pressing surface 33*b* may be a flat surface whose entire area contacts the side surface 8*b*.

The head position adjusting device 30 may include a moving mechanism 34 which moves the movable member 32 in the ±Z directions. The moving mechanism 34 may include a threaded hole 32*b*, a bolt 36 and a restricting member 37. The threaded hole 32*b* may be formed in an upper portion of the movable member 32 along the Z direction. The bolt 36 may include threaded portion 36*a* which is screwed into the threaded hole 32*b* in a lower portion thereof. The restricting member 37 may restrict movement of the bolt 36 in the ±Z directions.

A pair of flanges 36*b* may be disposed at an upper portion of the bolt 36. The restricting member 37 may have a prismatic shape. The restricting member 37 may be disposed between the head supporting frame 3 and the head 2. The restricting member 37 may be secured to the side wall 3*b* of the head supporting frame 3. The restricting member 37 may restrict rotation of the movable member 32 by surrounding the prismatic movable member 32. A lower portion of the restricting member 37 may be provided with an opening 37*a* for passing the lower end of the movable member 32 such that the movable member 32 is movable in the −Z direction. An upper portion of the restricting member 37 may have a hole formed therein, through which the bolt 36 is passed. A top plate 37*b* may be interposed between the pair of flanges 36*b*.

Figure 4C:
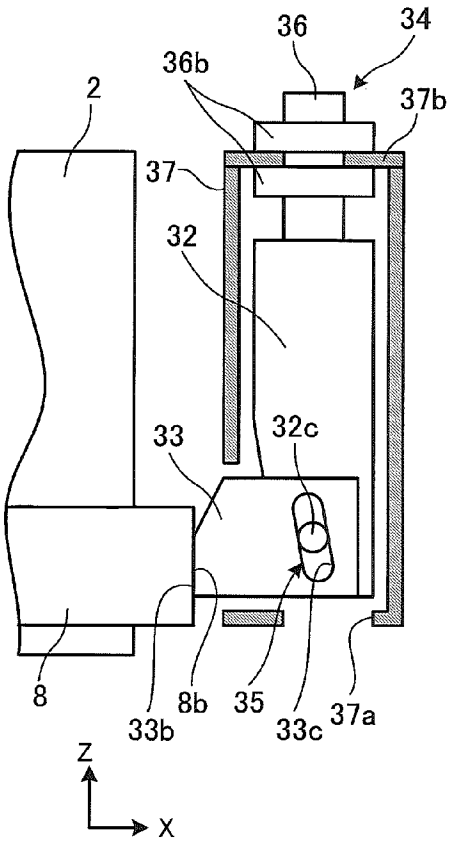

Referring to FIG. 4C, which is a partial sectional view of FIG. 4A, the head position adjusting device 30 may include an engaging mechanism 35 for engaging the movable member 32 with the pressing member 33. The engaging mechanism 35 may include a slit 33*c*, which is formed in the pressing member 33, and a pin 32*c* which is disposed at the movable member 32. The slit 33*c* may be formed so as to extend parallel to the inclined surface 32*a*. The pin 32*c* may be movably fitted into the slit 33*c*.

The length of the slit 33*c* may correspond to the amount of movement of the pressing member 33 in the ±X directions. That is, if the slit length is small, the amount of movement of the pressing member 33 in the ±X directions may be small. If the slit length is large, the amount of movement of the pressing member 33 in the ±X directions may be large. The inclined surface 32*a* and the contact surface 33*a* may be arranged to contact each other throughout a range of movement of the pressing member 33 corresponding to the slit length.

Referring to FIGS. 4A to 4C, the position of the head 2 in the X direction may be adjusted by manual rotation of the bolt 36 as follows. If the bolt 36 is rotated, the length of a portion where the threaded portion 36*a* of the bolt 36 is screwed into the threaded hole 32*b* of the movable member 32 may change. Since the movement of the bolt 36 in the ±Z directions is restricted by engagement of the pair of flanges 36*b* and the top plate 37*b*, when the length of the portion where the threaded portion 36*a* is screwed into the threaded hole 32*b* changes, only the movable member 32 may move vertically in the ±Z directions. More specifically, if the length of the portion of the threaded portion 36*a* that is screwed into the threaded hole 32*b* is reduced, the movable member 32 may move in the −Z direction. If the length of the portion of the threaded portion 36*a* that is screwed into the threaded hole 32*b* is increased, the movable member 32 may move in the +Z direction. Here, the movable member 32 may engage the pressing member 33 by the engaging mechanism 35, and may be surrounded by the prismatic restricting member 37, such that rotation of the movable member 32 is restricted. Accordingly, when the bolt 36 is rotated, thereby increasing or reducing the length of the portion of the threaded portion 36*a* that is screwed into the threaded hole 32, the moving mechanism 34 may cause the movable member 32 to move in the ±Z directions.

If the movable member 32 moves in the +Z direction, the inclined surface 32*a* may move upward. Therefore, the thickness of a portion of the movable member 32 which contacts the pressing member 33 in the X direction may be decreased. Since the pressing member 33 is pressed in the +X direction by the leaf spring 31 through the flat member 8, the pressing member 33 and the flat member 8 may move together in a direction in which the contact surface 33*a* and the inclined surface 32*a* contact each other, e.g., the +X direction. Therefore, the pressing member 33 and the flat member 8 both may move in the +X direction. In addition, the pin 32*c*, disposed at the movable member 32, may move obliquely upward in the slit 33*c* of the pressing member 33. Thus, the position of the head 2 in the +X direction may be adjusted.

When the movable member 32 moves in the −Z direction, the inclined surface 32*a* may move downward. Therefore, the thickness of the portion of the movable member 32 which contacts the pressing member 33 in the X direction may be increased. Therefore, the pressing member 33 may be pressed in the −X direction, and the pressing member 33 and the flat member 8 which contacts the pressing member 33 may move in the −X direction against an urging force of the leaf spring 31. Here, the pin 32*c*, disposed at the movable member 32, may move obliquely downward in the slit 33*c* of the pressing member 33. Thus, the position of the head 2 in the −X direction may be adjusted.

Here, since the flat member 8 is interposed between the reference contact member 70 and the leaf spring 71, the flat member 8 may move while the side surface 8*d* maintains contact with the reference contact member 70. Therefore, while the side surface 8*d* contacts with the reference contact member 70, the flat member 8 may move in the ±X directions.

During the above described position adjustment, the pressing member 33 may press the side surface 8*b*, without wear of the contacting surface of the pressing member 33 and the second side surface 8*b*, which is caused by rubbing the pressing member 33 and the second side surface 8*b* against each other. Accordingly, the position adjustment may be performed with high precision. The urging force of the leaf spring 31, which is large enough to press the head 2 against the pressing member 33, may be applied. Therefore, when the urging force of the plate spring 31 is small, and the movable member 32 is moved by the small urging force, fine position adjustment may be performed. Thus, fine position adjustment of the head 2 may be performed with high precision. The pressing member 33 may be prevented from moving in directions deviating from the ±X directions by engaging the movable member 32 and the pressing member 33 with each other using the slit 33*c*, which extends parallel to the inclined surface 32*a*, and the pin 32*c*, which is fitted to the slit 33*c*.

Referring back to FIG. 3A, in addition to the head position adjusting device 30, which adjusts the position of the head 2 in the ±X directions, a head position adjusting device 40 for performing position adjustment of the head 2 in directions differing from the ±X directions may be disposed at the head supporting frame 3 for each head 2.

The head position adjusting device 40 for each head 2 may include a leaf spring 41 and a pressing member 43. The leaf spring 41 may have an L shape. One end of the leaf spring 41 may be secured to the side wall 3*c* of the head supporting frame 3. A bent portion of the leaf spring 41 may contact the side surface 8*c* of the flat member 8. The bent portion of the leaf spring 41 may contact the side surface 8*c* of the flat member 8 and may urge the flat member 8 in the +Y direction. The pressing member 43 may have an C shape when viewed in plan view. The pressing member 43 may press the side surface 8*d* in the −Y direction at a position which corresponds to the position of the leaf spring 41 in the X direction.

The head position adjusting device 40 may be configured similarly to the head position adjusting device 30, so as to move the pressing member 43. That is, similarly to the movable member 32, the moving mechanism 34, and the restricting member 37 of the head position adjusting device 30, the head position adjusting device 40 may include a movable member contacting the pressing member 43, a moving mechanism which moves the movable member in the ±Z directions, and a restricting member which restricts rotation of the movable member. However, as the movable member of the head position adjusting device 40 moves in the ±Z directions, the pressing member 43 may move in the ±Y directions. As the pressing member 43 moves in the ±Y directions, an end portion, e.g., a right end portion as shown in FIG. 3A of the flat member 8 which is pressed against the pressing member 43 by the leaf spring 41, may move in the ±Y directions. An end portion, e.g., a left end portion as shown in FIG. 3A of the flat member 8, e.g., at a side opposite to where the pressing member 43 contacts the flat member 8, may be pressed against the reference contact member 70. Therefore, the flat member 8 may pivot about a contact point of the flat member 8 with the reference contact member 70 as a fulcrum. That is, with an axis extending vertically through the contact point as a center, the flat member 8 may move so as to describe an arc. Accordingly, the position of the head 2 may be adjusted in ±θ directions, as shown in FIG. 3A. Pivoting in the ±θ directions may occur along the discharge surface 2*a*. Thus, discharge surface 2*a* may be pivoted in the ±θ directions while it is aligned horizontally.

The position of each head 2 may be adjusted to a predetermined position in an XY plane according to combination of the head position adjusting device 30, which adjusts the position of its corresponding head 2 in the ±X directions, and the head position adjusting device 40, which adjusts the position of its corresponding head 2 in the ±θ directions. Here, the XY plane is defined by the X direction and the Y direction.

When assembling the printer 1 or replacing the heads, the heads 2 may be mounted to the head supporting frames 3 to which the position adjusting devices 30 and 40 are secured, or may be demounted from the head supporting frames 3. For example, in mounting any head 2 to the head supporting frame 3, after horizontally aligning the head 2 by a certain degree with respect to the head supporting frame 3, as shown in FIG. 5, the head 2 may be moved towards the head supporting frame 3 from above. Then, the body portion 2*b* of the head 2 may be moved downward to a position where it is supported by the supporting members 72. Thus, the flat member 8 at the body portion 2*b* may be vertically supported by the supporting members 72, and may be horizontally supported by each portion of the head position adjusting device 30 and each portion of the head position adjusting device 40.

The ink path pipes 51 and 52 may be connected to the sub tank units 23 and 24 from above the sub tank units 23 and 24. The ink path pipes 51 and 52 may extend vertically downward from the projection portion 2*c*. Therefore, the ink path pipes 51 and 52 may be connected to the respective sub tank units 23 and 24 at the same time as when the head 2 is mounted to the head supporting frame 3 from above the head supporting frame 3. The ink path pipes 51 and 52 may be disposed at the projection portion 2*c* projecting from the body portion 2*b* of the head 2, and may be positioned apart from the body portion 2*b*. Therefore, the sub tank units 23 and 24 may be easily connected to the respective ink path pipes 51 and 52.

When the head 2 is mounted to the head supporting frame 3, and the ink path pipes 51 and 52 are connected to the respective sub tank units 23 and 24, fine adjustment of a horizontal position of the head 2 may be performed by operating the head position adjusting devices 30 and 40, without disturbing the connection of ink path pipes 51 and 52 to the respective sub stank units 23 and 24. This may cause the head 2 to be horizontally positioned in a predetermined position.

According to the above described embodiment, the head position adjusting devices 30 and 40 may be disposed at the end portion at the side opposite to the ink path pipes 51 and 52, which are connected to the respective sub tank units 23 and 24, in the X direction. The connection portion where the sub tank units 23 and 24 are connected in each head 2 may infrequently interfere with the head position adjusting devices 30 and 40, such that the position of each head 2 is easily adjusted.

In an embodiment of the invention as described above, for example, the projection portion 2*c* may project from an end portion of the body portion 2*b* in the −X direction from the body portion 2*b* of each head 2, and the ink path pipes 51 and 52 may be disposed at each projection portion 2*c*. However, in another embodiment of the invention, e.g., a head 102 shown in FIG. 6, projection portion 102*c* may project in the Y direction from an end portion of a body portion 2*b*, and ink path pipes 51 and 52 may be disposed at the projection portion 102*c*.

The above described embodiment describes the reference contact member 70 as a reference for position adjustment. Nevertheless, in another embodiment of the invention, reference contact member 70 may be omitted. For example, with the connection portions of the ink path pipes 51 and 52 functioning as references, position adjustment in a rotational direction around the references as centers may be performed. In yet another embodiment of the invention, a plurality of members functioning as references of position adjustments, similar to the reference contact member 70, may be disposed around heads 2.

In the above described embodiment, each ink path pipe 51 may supply ink to each head 2, and each ink path pipe 52 may discharge ink from each head 2. However, in another embodiment of the invention, ink may be supplied to each head 2 using both the ink path pipes 51 and 52. In addition, although, in the above described embodiment, the ink path pipes 51 and 52 may project from each head 2, in another embodiment of the invention, the ink path pipes 51 and 52 may project from the sub tank units 23 and 24, and may be inserted in recesses of the heads 2.

Although, in the above described embodiment, the recording apparatus is an inkjet printer including a inkjet head which discharges ink so as to record an image onto a recording medium, the invention is not limited thereto. For example, in other embodiments, the invention may be applied to a liquid drop discharging head for forming fine wiring patterns on a substrate by discharging conductive paste, or forming a high-definition display by discharging an organic light emitting material onto a substrate, or forming a tiny electronic device, such as an optical waveguide, by discharging optical resin onto a substrate.

While the invention has been described in connection with various exemplary structures and illustrative embodiments, it will be understood by those skilled in the art that other variations and modifications of the structures and embodiments described above may be made without departing from the scope of the invention. Other Structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A recording apparatus comprising:

a recording head comprising a discharge surface in which a plurality of liquid discharge openings are arranged in a particular direction;

a supplying member which is positioned at a first end portion of the recording head in the particular direction, and is configured to supply the liquid to the recording head;

a liquid supplying device which is connected to the supplying member, and is configured to supply the liquid to the recording head;

a position adjusting device comprising a contact member configured to contact the recording head and a movable member configured to contact the contact member, the contact member comprising a first inclined surface and the movable member comprising a second inclined surface that contacts the first inclined surface, such that the contact member moves the recording head, via movement of the movable member, to adjust a position of the recording head; and an engaging mechanism configured to engage the movable member with the contact member, the engaging mechanism comprising a slit formed in the contact member substantially parallel to at least one of the first inclined surface and the second inclined surface, and a pin disposed on the movable member and configured to movably fit into the slit, wherein the position adjusting device is positioned at a second end portion opposite to the first end portion in the particular direction.

2. The recording apparatus according to claim 1, wherein the discharge surface is elongated in the particular direction.

3. The recording apparatus according to claim 1, further comprising an axis supporting device which is configured to axially support the recording head, such that the recording head pivots in a pivoting direction in which the first end portion of the recording head is fixed;

wherein the position adjusting device is configured to adjust the position of the recording head in the pivoting direction.

4. The recording apparatus according to claim 3, wherein the position adjusting device is configured to adjust the position of the recording head in the pivoting direction around a support axis where the axis supporting device axially supports the recording head, and wherein the supplying member and the liquid supplying device are connected to each other in a direction along the support axis.

5. The recording apparatus according to claim 4, wherein the support axis is orthogonal to the discharge surface.

6. The recording apparatus according to claim 3, wherein the axis supporting device comprises a particular reference contact member which contacts the first end portion of the recording head; and wherein the position adjusting device is configured to adjust the position of the recording head, wherein a portion of the particular reference contact member where the particular reference contact member contacts the recording head acts as a fulcrum.

7. The recording apparatus according to claim 1, wherein an axis supporting device comprises a further reference contact member which contacts the first end portion of the recording head; and wherein the position adjusting device is configured to adjust the position of the recording head in the particular direction while moving a surface of the recording head along the further reference contact member.

8. The recording apparatus according to claim 1, further comprising a discharging member which is positioned at the first end portion in the particular direction, and is configured to discharge the liquid from the recording head.

9. The recording apparatus according to claim 8, further comprising a liquid discharging device which is connected to the discharging member and is configured to discharge the liquid from the recording head.

10. The recording apparatus according to claim 1, further comprising a supporting member which is configured to selectively support the recording head when the recording head is mounted; and wherein the position adjusting device is secured to the supporting member.

11. The recording apparatus according to claim 1, wherein the recording head further comprises a substantially parallelepiped body portion which is elongated in the particular direction, and a projection portion which projects from a first end in the particular direction, and wherein the supplying member is disposed at the projection portion.

12. The recording apparatus according to claim 1, wherein the liquid supplying device comprises an integral liquid supplying unit comprising a liquid tank which is configured to store the liquid; and wherein the liquid supplying unit is secured to a predetermined position, and is integrally connected to the supplying member.

13. The recording apparatus according to claim 12, further comprising a device housing, wherein the predetermined position is within the device housing.

14. The recording apparatus according to claim 1, further comprising a plurality of recording heads which are arranged such that each particular direction corresponding to each recording head of the plurality of recording heads is parallel, and wherein each of the plurality of recording heads comprises a respective position adjusting device which is arranged side by side along a further direction orthogonal to each particular direction.

15. A position adjusting method of a recording head, the recording head comprising a discharge surface having a plurality of discharge openings arranged in a particular direction, the method comprising the steps of:

operating a position adjusting device to move a contact member via a movable member, the contact member comprising a first inclined surface and the movable member comprising a second inclined surface that contacts the first inclined surface;

contacting the recording head with the contact member, the recording head having a first end and a second end opposite the first end in the particular direction;

moving the second end of the recording head through movement of the contact member, which is moved, through movement of the movable member, by the operation of the position adjusting device, such that a pin disposed on the movable member movably engages with a slit formed in the contact member substantially parallel to at least one of the first inclined surface and the second inclined surface; and holding stationary the first end of the recording head, to supply liquid to the recording head from a supplying member disposed at the first end, wherein the moving step and the holding step occur simultaneously.

* * * * *